US010834977B2

(12) United States Patent
Das

(10) Patent No.: US 10,834,977 B2
(45) Date of Patent: Nov. 17, 2020

(54) STRETCHABLE GARMENT BAND

(71) Applicant: Parul Das, Irving, TX (US)

(72) Inventor: Parul Das, Irving, TX (US)

( * ) Notice: Subject to any disclaimer, the term of this patent is extended or adjusted under 35 U.S.C. 154(b) by 218 days.

(21) Appl. No.: 16/033,186

(22) Filed: Jul. 11, 2018

(65) Prior Publication Data

US 2019/0014832 A1 Jan. 17, 2019

Related U.S. Application Data

(60) Provisional application No. 62/531,089, filed on Jul. 11, 2017.

(51) Int. Cl.

| | |
|---|---|
| ***A41D 1/00*** | (2018.01) |
| ***A41D 1/22*** | (2018.01) |
| ***A41D 1/14*** | (2006.01) |
| ***A41B 9/10*** | (2006.01) |
| ***A41F 9/02*** | (2006.01) |

(52) U.S. Cl.

CPC ..... *A41D 1/22* (2013.01); *A41B 9/10* (2013.01); *A41D 1/14* (2013.01); *A41F 9/02* (2013.01)

(58) Field of Classification Search

CPC .... A41D 1/22; A41D 1/14; A41B 9/10; A41F 9/02

See application file for complete search history.

(56) References Cited

U.S. PATENT DOCUMENTS

| | | | | | |
|---|---|---|---|---|---|
| 993,886 | A * | 5/1911 | Schmitz | A41F 9/02 | 2/237 |
| 1,048,633 | A * | 12/1912 | Zurn | A41F 9/02 | 2/237 |
| 2,109,280 | A * | 2/1938 | Bach | A41F 9/02 | 2/237 |
| 3,098,238 | A * | 7/1963 | Diamond | A41F 9/02 | 2/237 |
| 3,478,367 | A * | 11/1969 | Vatti | A41D 1/22 | 2/76 |
| 3,800,332 | A * | 4/1974 | Forrest | A41D 1/06 | 2/237 |
| 3,840,899 | A * | 10/1974 | Saxena | A41D 1/22 | 2/74 |
| 5,802,619 | A * | 9/1998 | Ralston | A41F 9/02 | 2/220 |
| 6,880,175 | B2 * | 4/2005 | Tajima | A41F 9/025 | 2/221 |
| 7,757,308 | B2 * | 7/2010 | Oomae | A41F 9/025 | 2/237 |
| 2016/0021943 | A1 | 1/2016 | Das | | |

* cited by examiner

*Primary Examiner* — Steven O Douglas

(57) ABSTRACT

An article of clothing that includes a waistband made from non-stretchable fabric. The waistband incorporates elastic throughout an interior portion, and the elastic is secured to the waistband at each side of one or more slits provided along the waistband. The slits along the waistband allow for the elastic to be hidden within the non-stretch fabric when the waistband is a rest while also allowing the elastic to stretch while robing, moving, dancing, and/or sitting.

12 Claims, 4 Drawing Sheets

STRETCHABLE GARMENT BAND

CROSS-REFERENCE TO RELATED APPLICATION

This application claims the benefit of U.S. Provisional Application 62/531,089, filed Jul. 11, 2017.

BACKGROUND

Many traditional Asian style garments are constructed using non-stretch fabrics such as chiffon, georgette, crepe silk, cotton, net, etc. These non-stretch fabrics have little to no elasticity and therefore tend to be tedious and uncomfortable to wear. For example, a sari is a traditional Asian garment that is made from six to nine yards of non-stretch fabric that is draped over the body and requires several additional supplies such as a petticoat, blouse, & several safety pins to be worn properly.

Due to the detailed and time-consuming methods of draping a sari, many women have abandoned the traditional sari and opt for easier to wear garments. For example, pre-stitched sari garments have been attempted in various constructions to simplify the task of draping a sari. Some of these pre-stitched garments provide pleated fabric stitched down using conventional stitching, with an elastic panel stitched into a tubular sheath, a zipper and hook & eye closures and still requires the use of a tied petticoat beneath the sari. However, such a construction leads to bunching and gathering of fabric along the waistline. When worn correctly in a traditional manner, no gathering or bunching of fabric should occur, especially along the waistline.

Other pre-stitched saris have included pleats formed in the front, requiring the user to zip themselves into the garment, looking like a one-piece Western dress garment rather than a sari, which traditionally shows the midriff and consists of a separate blouse piece. Once the zipper is closed, there is no room for expandability in this type of garment. Further attempts have provided pre-stitched or ready-to-wear sari "gowns" made using lycra, elastane swimsuit material, which can be very hot, is limited to solid colors and clings to the body.

These garments are illustrative of past attempts at pre-stitched sari garments, and all of them have added to the bulkiness and discomfort of wearing a traditional sari and fail to mimic the features of a traditional sari. For example, some of the described pre-stitched saris do not offer an enclosed petticoat stitched into the sari portion, requiring the user to wear a petticoat under the pre-stitched sari and still pinning or hooking the sari around the waist. This is not as secure as if the entire petticoat is stitched into a sari that is enclosed at least at the waist. Furthermore, wearing a tight petticoat under a pre-stitched sari makes the pre-stitched sari that much more difficult to put on and neither tend to stay in place. Additionally, these described garments leave the users concerned that the hooks may come undone, or they don't allow for comfortable breathing because the hooks are too tightly connected to prevent the sari from falling off.

Accordingly, past attempts at pre-stitched saris have failed to allow for expandability and comfort, while avoiding the bulk of fabric that can accumulate when a sari is traditionally wrapped, pleated and tucked into a petticoat. There is a need for a pre-pleated, easy to pull on skirt-like sari made using traditional non-stretch fabric that maintains the appearance of a traditional sari and provides the comfort and mobility of a stretchable skirt. Such ready to wear saris should also include an enclosed petticoat lining and allows for expandability, mobility, breathability, and ease of pulling on and off without hooks, zippers, and fasteners that dig into the skin and ruin the outward appearance of the sari.

SUMMARY

The preceding Summary is intended to serve as a brief introduction to various features of some exemplary embodiments. Other embodiments may be implemented in other specific forms without departing from the scope of the disclosure.

Some embodiments provide an article of clothing that includes a waistband made primarily from non-stretchable fabric. The waistband has a first edge and a second edge and elastic is enclosed throughout the entirety of the waistband. At least one slit is included the waistband, where each slit starts at the first edge of the waistband. A first stitch at a right side of every slit spans from the second edge to the first edge, and the distance of the first stitch from the slit increases from the second edge to the first edge. A second stitch at a left side of every slit spans from the second edge to the first edge, and the distance of the second stitch from the slit also increases from the second edge to the first edge thereby forming a "V" or upside down "V" stitch at each slit in the waistband. Other embodiments may form a vertical right and left stitch that is equidistant from the slit.

In some embodiments, each slit ends before the second edge. Several different garments may be formed using the waistband of the present disclosure. One exemplary embodiment includes a ready to wear sari bottom attached to the waistband, where the sari bottom is substantially made of the same non-stretchable fabric used to construct the waistband. As found in traditionally worn saris, some embodiments may include a pre-pleated portion of the sari bottom located at a front side of the waistband. The pre-pleated portion may be secured to the waistband at a bottom interior edge of the waistband. A petticoat may also be enclosed within the sari bottom of some embodiments, where the petticoat and the sari bottom are both secured to the waistband at a bottom interior edge of the waistband.

BRIEF DESCRIPTION OF THE SEVERAL VIEWS OF THE DRAWINGS

The exemplary features of the disclosure are set forth in the appended claims. However, for purpose of explanation, several embodiments are illustrated in the following drawings.

FIG. 1 also illustrates the pallu wrapped around the body and draped over the left shoulder.

DETAILED DESCRIPTION

Figure 1:
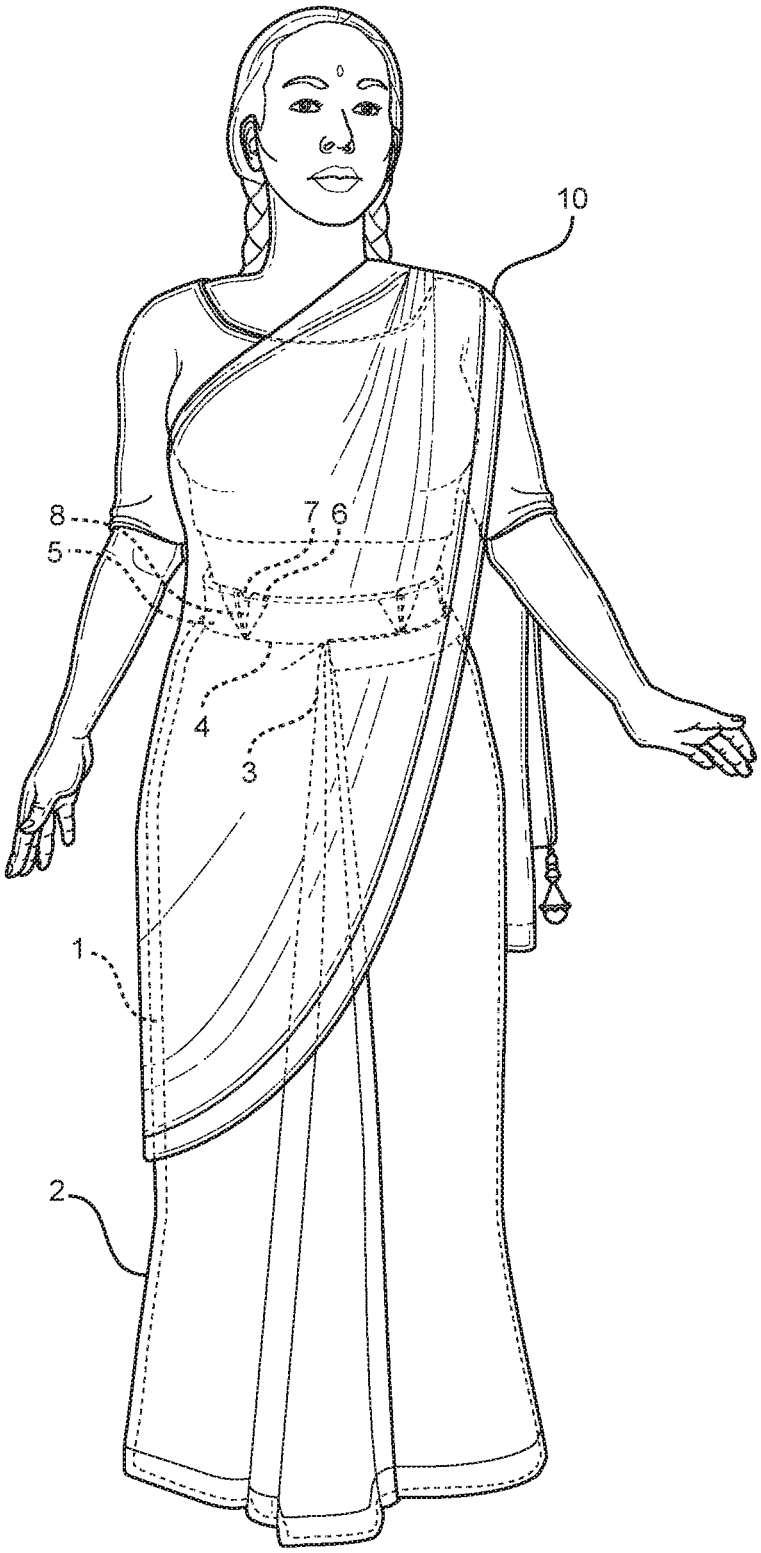
FIG. 1 is a front view of a woman wearing an exemplary embodiment of a ready to wear sari garment according to the present disclosure. The ready to wear sari includes an enclosed petticoat skirt stitched to the sari fabric and a pleated portion, all of which are discreetly sewn into the waistband of the sari bottom.

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide a ready to wear sari bottom that one can step into or slip over their heads like a skirt. The sari fabric is stitched into a specially constructed waistband that also includes the sari fabric to camouflage the existence of the waistband and the pre-stitched pleats that are very bulky and obvious in other ready to wear saris. The ready to wear sari provides a secure method to stitch sari pleats into the waistband, and it includes a petticoat, sari fabric, and elastic while avoiding the use of several hook & eye closures, zippers and/or any other metal portion that can restrict breathability and dig into the user's skin during use. The disclosed waistband and its construction allow for non-stretch fabrics to maintain the look of traditional Asian garb while allowing expansion and comfort when worn.

Referring to FIGS. 1-5, the illustrated embodiments provide an easy to wear pre-stitched sari garment. A traditionally worn sari requires a tight petticoat, and a considerable amount of time and knowledge to properly position, pleat, and drape on the user's body and is typically uncomfortable and difficult to wear. Some embodiments described in the present disclosure provide a single garment that includes a sari bottom with an enclosed petticoat stitched into a waistband that is constructed to provide comfort and expandability while worn. Both the petticoat and the sari fabric, including the pre-pleated portion of the outer sari layer may be enclosed at the bottom interior edge of the waistband, which includes hidden openings of elastic.

In some embodiments, the elastic is enclosed throughout the entirety of the waistband and, based on the style of the garment, may only become visible at openings (e.g vertical slits, etc.) in the waistband. In some embodiments the openings may be stitched at an angle to reduce the bunching of the non-stretchable fabric and provide a smooth appearance, such as the appearance desired when wearing a sari or other traditional Asian garb. In some embodiments this slit may be a V-shape or upside down V where the vertical slit run from a top/bottom edge of the waistband to slightly above/below the bottom/top of the waistband. Based on a desired design, this slit may be stitched at any angle while allowing the non-stretch material appear to be seamless when at rest. The elastic can be hidden when the waistband is at rest within the non-stretch fabric and become visible when the waistband is stretched in some embodiment, while other embodiments may display the elastic portions as part of the ornamental design or style of the garment. Some embodiments may be tubular with elastic running throughout, while others may include alternating portions of elastic and non-stretch material sewn together to form a waistband.

The waistband according to the present disclosure secures elastic to non-stretchable fabric (e.g., chiffon, georgette, crepe silk, cotton, net, etc.) using specific stitching, such as angled or v-shaped stiches, in order to provide several advantages that include ease of use, adjustability when robing/un-robing, comfort, no bunching of fabric, elegant design and appearance, etc. for garments that are primarily and traditionally made using non-stretch fabrics, especially garments having Asian influence and design.

An exemplary method of constructing one embodiment of the disclosed waistband will now be discussed. This exemplary embodiment is not meant to be limiting and may include more or less material and be combined in various different ways without departing from the scope of the present disclosure.

In the following exemplary embodiment, the waistband may appear tapered, with a smaller circumference at the top and a wider circumference at the bottom. Depending on the desired number of stretchable portions in the waistband, the waistband may be constructed using four to twelve or more pieces of non-stretchable fabric that encases a continuous piece of elastic. The waistband includes "V" shaped notches or gores at intervals to from the stretchable portions of the waistband.

In this exemplary construction, each piece of non-stretchable fabric is trapezoidal in shape and fused with interfacing. Correlating pieces of the trapezoidal fabric are sewn together, short sides matching up to another, to create a seam that will serve as the top edges of the waistband segments. The wide seam allowances on the ends of each piece are folded back to form finished edges for the "V" openings for the elastic. In some embodiments, sections of gripper tape may then be sewn on the interior of the back waistband segments.

Next, the waistband may start to be affixed to a garment made with the same non-stretchable fabric. Such garments may include skirts, pants, shorts, and various traditional Asian garb. For this example, the waistband will be attached to the disclosed ready to wear sari garment. This next step may begin with taking the bottom of the exterior of the waistband segments and sewing/serging them into a combined pleated sari and petticoat portion, as one continuous piece. In some embodiments, an opening on the side seam may be left for the addition of a zipper.

Then the inner waistband segments may be folded down and stitched along the same line as the exterior waistband seam. The elastic can then be inserted through the waistband and anchored/sewn at one or more side seams, or alternatively at each side of a zipper opening for embodiments with a zipper.

The "V" shaped gores may then be stitched onto the assembled waistband, at both sides of each opening, through the elastic and waistband assembly. The resulting waistband stretches at the "V" gores to allow for expansion, but the gores are closed when not expanded, giving the appearance of a continuous fabric waistband. One exemplary method to achieve the "V" stitch is to start a first stitch at a right side of each slit spanning from the second edge to the first edge, wherein the distance of the first stich from the slit increases from the second edge to the first edge, and add a second stitch at a left side of each slit spanning from the second edge to the first edge, wherein the distance of the second stich from the slit increases from the second edge to the first edge. The V stich is an exemplary embodiment of the waistband and is functional in that it provides a seamless and clean look around the waistband while eliminating bunching and gathering of fabric. Other embodiments may use vertical stitching or patterned stitching to achieve similar results.

For embodiments that include a zipper, the final step includes inserting an invisible zipper, for example, at the side seam opening. Some embodiments may also include a hook and eye at the top of the zipper. The following description of the Figures will further illustrate an exemplary embodiment of a ready to wear sari garment according to the present disclosure.

FIG. 1 is a front perspective view of an exemplary embodiment of a ready to wear sari garment and is shown demonstrating the draped sari. The garment includes a petticoat 1 with the sari fabric 2 wrapped around and enclosed at the bottom inside edge of the waistband 5. The pre-pleated portion of the sari 3 is located in the front and stitched into the bottom of the waistband 4. The waistband 5 includes the same fabric as the sari for a smooth, discreet transition. In some embodiments, elastic 7 is enclosed within the entire waistband 5, but only visible at the openings 8, which are discreetly hidden using angled stitching 6. The angled stitching 6 allows for stretch, but prevents the gathering and bunching that typically accompanies the use of tubular elastic. In order to accommodate wider hip sizes, some embodiments may include a zipper 9 at the side, which provides the user with a wider area to step into the skirt and pull the skirt over the hips. In some embodiments, the remainder of the sari fabric, the pallu 10 is left unstitched and draped around the back of the woman, to the front and draped over her left shoulder.

Figure 2:
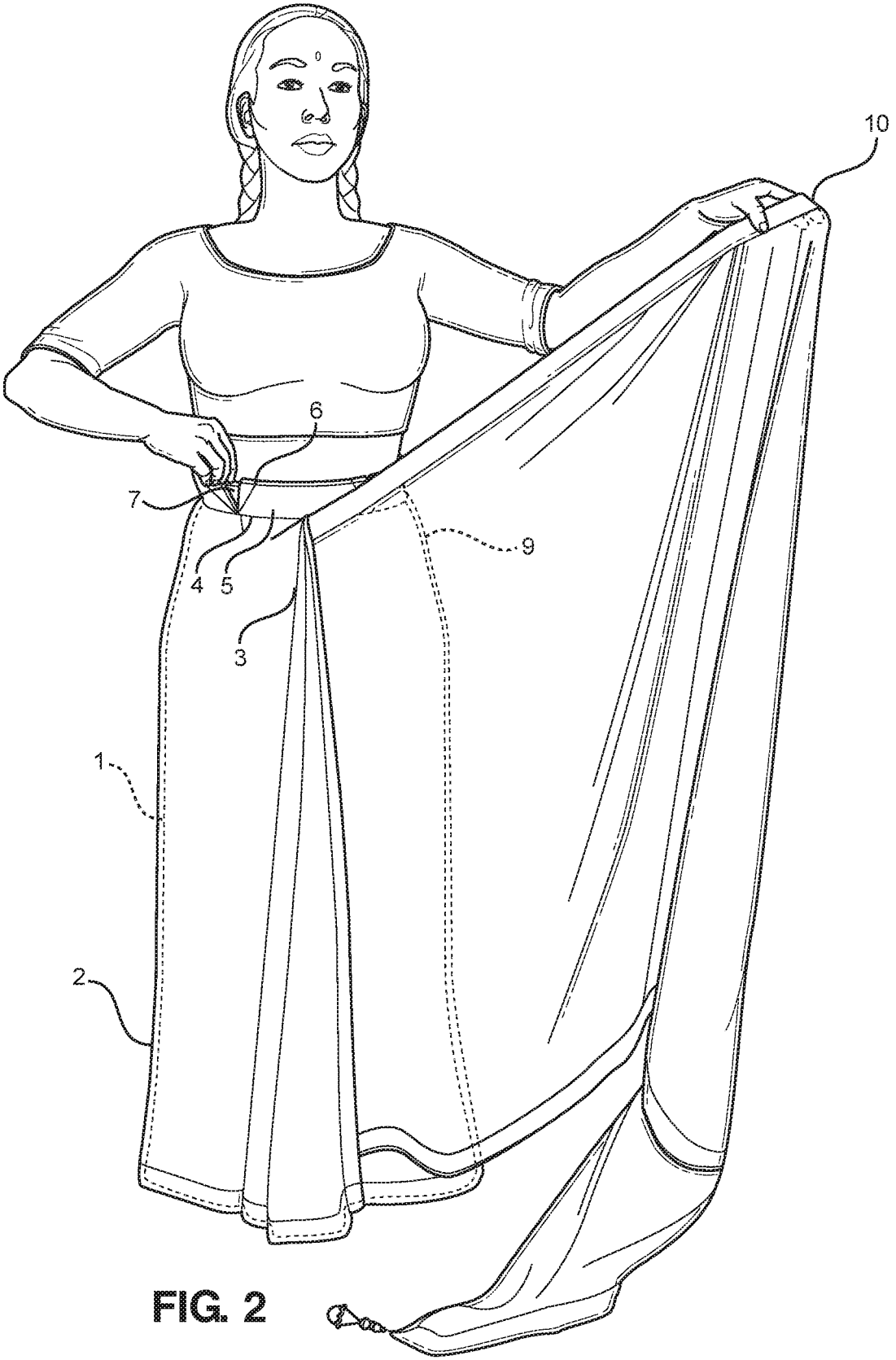
FIG. 2 illustrates a front view of a woman wearing a separate blouse and the ready to wear sari of FIG. 1.

With regard to FIG. 2, a front perspective view of the ready to wear sari garment is shown without the draped pallu 10 over the shoulder. The pre-pleated portion 3 is located in the front and stitched into the bottom of the waistband 4, with the petticoat 1 also enclosed at the bottom interior edge of the waistband 5. In some embodiments, the petticoat 1 may be stitched vertically as well, but the sari 2 is only stitched and enclosed at the waistband, not vertically.

Figure 3:
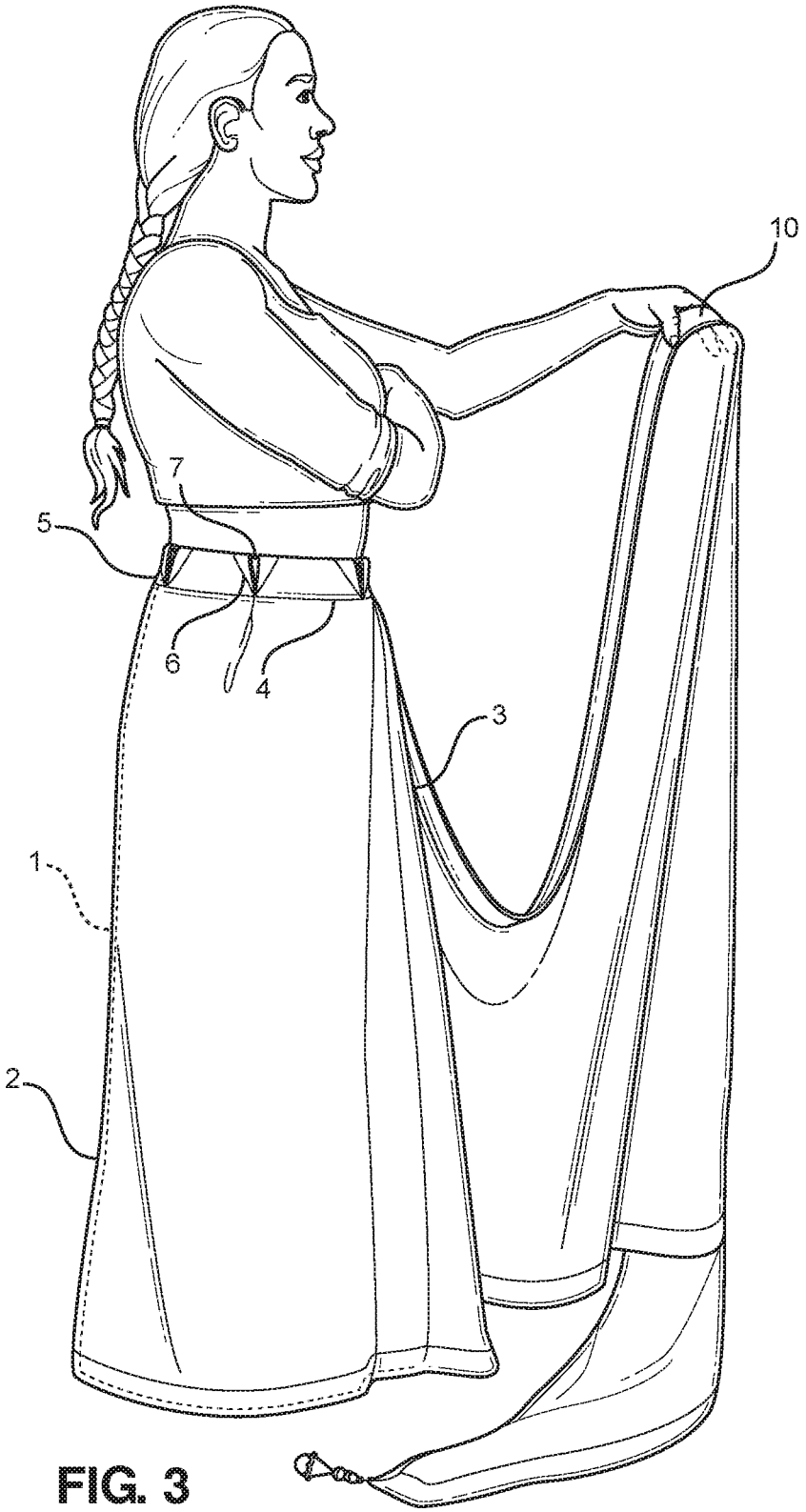
FIG. 3 is a side view of the ready to wear sari of FIG. 1 showing additional openings of elastic on the side of the waistband.

With regard to FIG. 3, a side perspective view of the ready to wear sari garment is shown without the draped pallu 10 over the shoulder. FIG. 3 illustrates additional openings of elastic on the side of the waistband.

Figure 4:
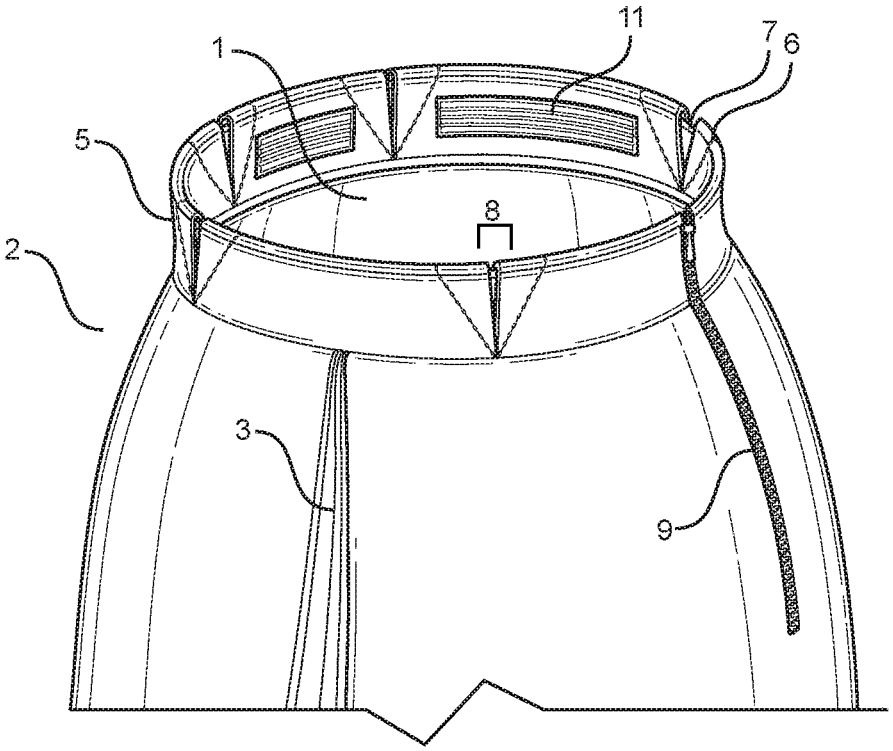
FIG. 4 is an aerial view of the waistband that includes sari fabric and elastic, where the elastic is visible only when the waistband is stretched.
Figure 5:
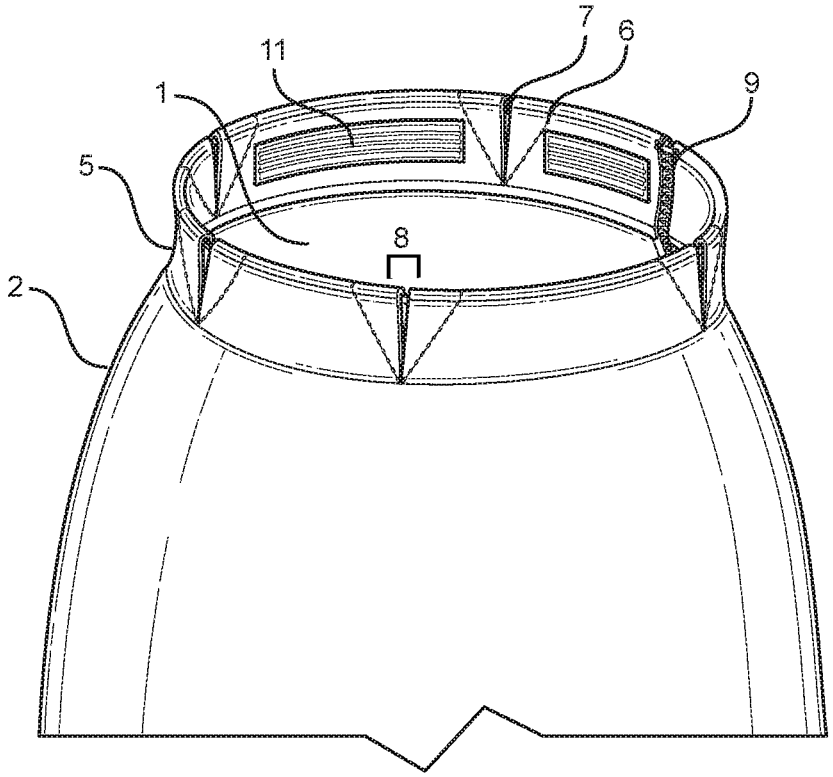
FIG. 5 is an aerial view of the side of the waistband at rest, showing the narrow opening of the hidden elastic, covered by the sari fabric that the waistband is made with, discreetly hiding the elastic.

With regard to FIG. 4, a perspective view of the sari garment is shown depicting the visibility of the elastic 7 when the waistband 5 is stretched. The garment includes an enclosed petticoat 1 stitched to the sari fabric 2 wrapped around and enclosed at a bottom interior edge of the waistband 5. The method of stitching the tubular elastic in a "V" shape prevents the elastic from bunching at any point on the waistband 5, while allow for stretch within the waistband 5. The waistband 5 and part of the skirt may include a zipper 9, which allows the user to step into the garment with greater ease. Some embodiments may also include rubber grippers 11 that may be sewn into the interior of the waistband to prevent the sari skirt from twisting around the waist, ensuring that the pleats 3 stay in the front. FIG. 5 illustrates a further perspective view of the side of the ready to wear sari garment.

The foregoing relates to illustrative details of exemplary embodiments and modifications may be made without departing from the scope of the disclosure as defined by the following claims.

I claim:

1. An article of clothing comprising:

a waistband comprising non-stretchable fabric, having a first edge and a second edge;

elastic enclosed throughout the entirety of the waistband;

at least one slit in the waistband starting at the first edge of the waistband and ending before the second edge;

a first stitch at a right side of every slit, spanning from the second edge to the first edge, wherein the distance of the first stich from the slit increases from the second edge to the first edge; and a second stitch at a left side of every slit, spanning from the second edge to the first edge, wherein the distance of the second stich from the slit increases from the second edge to the first edge.

2. The article of clothing of claim 1 further comprising a sari bottom attached to the waistband, wherein the sari bottom is substantially the same non-stretchable fabric used to construct the waistband.

3. The article of clothing of claim 2, wherein the sari bottom comprises a pre-pleated portion at a front side of the waistband.

4. The article of clothing of claim 3, wherein the pre-pleated portion is secured at a bottom interior edge of the waistband.

5. The article of clothing of claim 2 further comprising a petticoat enclosed within the sari bottom, wherein the petticoat and the sari bottom are secured to the waistband at a bottom interior edge of the waistband.

6. The article of clothing of claim 2 further comprising a pallu that is not secured to the waistband and extends from the pre-pleated portion of the sari bottom.

7. An article of clothing comprising:

a waistband comprising non-stretchable fabric, having a first edge and a second edge;

elastic enclosed throughout the entirety of the waistband;

at least one slit in the waistband starting at the first edge of the waistband and ending before the second edge;

a first stitch at a right side of every slit, spanning from the second edge to the first edge, wherein the distance of the first stitch from the slit remains the same from the second edge to the first edge; and a second stitch at a left side of every slit, spanning from the second edge to the first edge, wherein the distance of the second stitch from the slit remains the same from the second edge to the first edge.

8. The article of clothing of claim 7 further comprising a sari bottom attached to the waistband, wherein the sari bottom is substantially the same non-stretchable fabric used to construct the waistband.

9. The article of clothing of claim 8, wherein the sari bottom comprises a pre-pleated portion at a front side of the waistband.

10. The article of clothing of claim 9, wherein the pre-pleated portion is secured at a bottom interior edge of the waistband.

11. The article of clothing of claim 8 further comprising a petticoat enclosed within the sari bottom, wherein the petticoat and the sari bottom are secured to the waistband at a bottom interior edge of the waistband.

12. The article of clothing of claim 8 further comprising a pallu that is not secured to the waistband and extends from the pre-pleated portion of the sari bottom.

* * * * *